United States Patent [19]

Kennedy

[11] Patent Number: 4,934,904

[45] Date of Patent: Jun. 19, 1990

[54] AXIAL FAN

[75] Inventor: David W. Kennedy, Newfane, N.Y.

[73] Assignee: TCF Axial Division, Inc., Minneapolis, Minn.

[21] Appl. No.: 304,492

[22] Filed: Jan. 31, 1989

[51] Int. Cl.[5] ..... F04D 29/36

[52] U.S. Cl. ..... 416/207; 416/135

[58] Field of Search ..... 416/207, 208, 206, 135 R

[56] References Cited

U.S. PATENT DOCUMENTS

| | | | |
|---|---|---|---|
| 2,307,490 | 1/1943 | Curley | 416/207 |
| 2,936,155 | 5/1960 | Howell et al. | 416/208 |
| 3,323,710 | 6/1967 | Daly | 416/207 |
| 3,357,496 | 12/1967 | Petersen | 416/207 |
| 3,428,244 | 2/1969 | Palmer | 416/207 X |
| 3,545,884 | 12/1970 | Schroeter et al. | 416/207 X |
| 3,561,883 | 2/1971 | Berry | 416/207 X |
| 3,799,699 | 3/1974 | Master et al. | 416/206 |
| 4,012,171 | 3/1977 | Suvak | 416/207 |

FOREIGN PATENT DOCUMENTS

| | | | |
|---|---|---|---|
| 224796 | 12/1962 | Austria | 416/207 |
| 643236 | 6/1962 | Canada | 416/207 |
| 2550755 | 5/1977 | Fed. Rep. of Germany | 416/207 |
| 808051 | 1/1937 | France | 416/207 |
| 20593 | 2/1977 | Japan | 416/208 |
| 826519 | 1/1960 | United Kingdom | 416/207 |
| 887098 | 1/1962 | United Kingdom | 416/207 |
| 903792 | 8/1962 | United Kingdom | 416/207 |
| 1043707 | 9/1966 | United Kingdom | 416/207 |

*Primary Examiner*—Everette A. Powell, Jr.

*Attorney, Agent, or Firm*—Kinney & Lange

[57] ABSTRACT

An axial fan construction wherein individual blade assemblies are secured within apertures in the fan hub. Fasteners extend between a retaining member and a blade base, with each blade base including a shoulder overlying a bearing surface on the hub and with resilient members positioned between the blade base shoulders and hub bearing surfaces. A spacer maintains the blade base shoulders and retaining members a preselected distance apart to allow prestressing of the fasteners while limiting the compressive force applied to the resilient member. The blade base shoulders and hub bearing surfaces are configured to cooperate with the resilient member to impart a centering force on the blade base relative to a hub aperture when the resilient member is compressed between the blade shoulder and hub bearing surface.

14 Claims, 2 Drawing Sheets

AXIAL FAN

BACKGROUND OF THE INVENTION

1. Field of the Invention.

The present invention relates to axial fans and, particularly, to a construction for securing individual fan blade assemblies within apertures in a fan hub whereby the blade assemblies are centered within the hub apertures and the fan, itself, is statically and dynamically balanced.

2. Description of the Prior Art.

Axial fan constructions wherein individual blade assemblies are secured within apertures in the fan hub are known to the prior art. An example of such a construction is shown in the U.S. Pat. No. 3,545,884, issued Dec. 8, 1970, for ADJUSTABLE FAN CONSTRUCTION to J. W. Schroeter et al. The Schroeter et al. construction employs an air foil extending from a base with the base having a cylindrical portion which fits into a counterbore in a fan hub assembly. The cylindrical portion provides a shoulder in opposing relation to a face of the counterbore with a resilient member being positioned between the counterbore face and base shoulder. A retaining disc allows a clamping action to secure the blade assembly to the hub by bolts extending between the disc and the blade base.

The Schroeter et al. construction positions a spacer between the retaining disc and blade base to allow a prestressing of the bolts while limiting the amount of compression of the resilient member. In this manner, the bolts that secure the blade assembly to the hub may be prestressed to counter fatigue failure while the limit on compression in the resilient member limits the force necessary to realign the blade relative to the hub. Thus, it is possible to securely clamp the blade assembly to the hub while allowing a manual adjustment of the blade assembly.

SUMMARY OF THE INVENTION

The present invention provides an axial fan construction of the general type disclosed by Schroeter et al., including a prestressing of the clamping fasteners to avoid fatigue failure, and may be constructed to allow a manual repositioning or reorientation of the blades relative to the hub. In addition, the present invention provides a retaining assembly for an axial fan blade which automatically centers the fan blade relative to a radial axis along which the blade assembly is positioned. In a preferred embodiment, the blade assembly has it's center of gravity located along a radial center line that is coincident with the radial axis, while a construction in accordance with the present invention provides an automatic "centering" to maintain the radial center line along a radial axis. The automatic centering allows a relaxation of tolerances within the retaining assembly. It should be noted that a feature of a fan constructed in accordance with the present invention is the elimination of bending forces. Such forces are established only when the blade assembly is not centered and are eliminated by the automatic centering.

As indicated, in a preferred embodiment, the retaining assembly of the present invention may be constructed to allow manual adjustment, as by rotation of the blade assembly about its radial center line. The automatic centering discussed above not only maintains alignment of the individual blade assemblies but, also, maintains balance of the fan itself. In addition, proper selection of materials provides an automatic self-damping which decreases vibration induced stress of the blades and a reduction of the potential for fatigue failure of a blade. In a preferred embodiment, individual blade assemblies are clamped within apertures in a fan hub by fasteners extending between a retaining plate and a base which forms a part of the blade assembly. Each blade base includes a shoulder which overlies a bearing surface on the hub with a resilient member being positioned between the blade base shoulder and the hub bearing surface. The blade base shoulders and hub bearing surfaces are configured to cooperate with the resilient member to impart a centering force on the blade base (relative to a hub aperture) on compression of the resilient member between the blade shoulder and hub bearing surface. Prestressing of the fasteners used to clamp the blade assembly to the base, as disclosed in the above-identified Schroeter et al. patent (which is hereby incorporated by reference herein), is retained.

DETAILED DESCRIPTION OF THE PREFERRED EMBODIMENT

Figure 1:
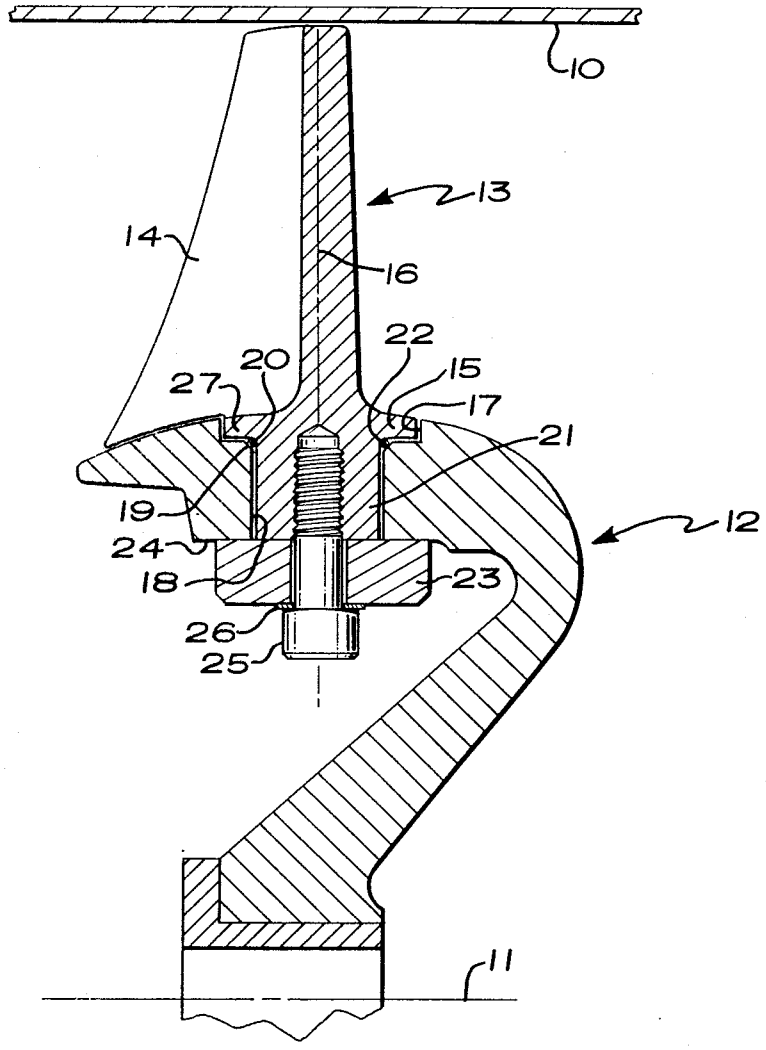
FIG. 1 is a cross-section of a portion of an axial fan in accordance with the present invention.

Referring now to FIG. 1, there is illustrated a cross-section of a portion of an axial fan including a single blade assembly, the fan being located within a duct 10 and rotatable about a rotation axis 11 (as by a shaft), in known manner. A hub 12 extends from and around the rotation axis 11 and is secured to a shaft lying along the rotation axis 11 (not shown), for rotation therewith, in any desired manner. The hub 12 carries a series of blade assemblies 13 (one shown), each of which is expected to be identical to the illustrated assembly 13. The number of assemblies 13 is dependent upon the particular design and application.

Each of the blade assemblies 13 includes an air foil portion 14 and a base portion 15. The blade assembly 13 (including the air foil 14 and base portion 15) has its center of gravity lying along center line 16, the center line 16 being preferably coincident with a "radial axis" as that term is understood from the description below.

The base 15 includes a shoulder portion 27 that fits within a counterbore 17 of the hub 12, the counterbore 17 being an enlarged portion of an aperture 18 that extends through the hub 12. The counterbore 17 includes a bearing surface 19 in generally opposing relation to a radius 20, the radius 20 being formed at the junction of the shoulder 27 and a spacer portion 21 of the base 15. A resilient member 22 is positioned between the bearing surface 19 and radius 20.

A retaining plate 23 is positioned against an inner bearing surface 24 of the hub 12 while a threaded fastener 25 extends through the plate 23 and into engagement with threads within the base 15—within the spacer 21 in the embodiment shown. In the illustrated embodiment, the spacer 21 is unitary with the base 15. A washer 26 is provided to facilitate tightening of the fastener 25, in known manner.

As noted above, the blade assembly 13 has its center of gravity located along a center line 16, the center line 16 preferably lying along an axis (a radial axis) extending radially outwardly from, and perpendicular to, the rotation axis 11. The shoulder 27 and spacer 21 of the blade base 15 are symmetrical with respect to the center line 16 while the counterbore 17, bearing surface 19 and aperture 18 of the hub 12 are symmetrical with respect to a radial axis. The plate 23, washer 26 and fastener 25 are symmetrical and are preferably positioned with their axis of symmetry coincident with a radial axis. The bearing surface 19 is preferably formed as a conical section that is coaxial with a radial axis.

As in the prior art Schroeter et al. patent, incorporated herein, the present invention provides a separation between the forces that retain the blade assembly in position on the hub during operation and those that maintain the blade position at rest. That is, the spacer 21 is dimensioned to maintain the shoulder 27 of base 15 at a preselected distance from the plate 23 on full tightening of the fastener 25. This maintains the shoulder 27 at a preselected distance from the counterbore 17 of the hub 12 (when the plate 23 is against the inner bearing surface 24 of the hub 12) and allows the fastener 25 to be preloaded so as to avoid fatigue failure in the fastener assembly, in known manner. During operation (during rotation of the fan assembly about the rotation axis 11), friction between the plate 23 and bearing surface 24 will maintain the relative position of the blade assembly 13 and the hub 12. When the fan wheel is at rest, however, it is the compression of the resilient member 22 (between the radius 20 and bearing surface 19), and the friction resulting from that compression, that serves to maintain the blade position relative to the hub 12. As is known from Schroeter et al., the relative dimensions of the parts can be selected such that the air foil 14 can be manually rotated about the axis 16 without loosening of the fastener 25. However, unlike the Schroeter et al. construction, the retaining assembly of the present invention provides an automatic centering of a blade assembly 13 along a radial axis. This is a result of the angle of the bearing surface 19—the forming of that surface as a conical section having its axis coincident with the radial axis—and the compression of the resilient member 22. That is, the angle of the bearing surface 19 results in a compressive force on the resilient member 22 having one component generally parallel to a radial axis and another component generally perpendicular to that axis. The parallel component provides a force required to maintain the blade in position at rest. The perpendicular component serves to urge the base 15 of a blade assembly 13, and its center line 16, toward the radial axis. In this manner, the tolerances of the components may be relaxed while still providing a centering of those components along the radial axis. In addition, during operation, should the blade center line/center of gravity be off the radial axis, the centrifugal force acting on the components of the blade assembly, and its retaining assembly, urges them to center their center lines/axes of symmetry along the radial axis. It should be noted that due to the symmetry of the several components and the fact that blade assembly 13 has its center of gravity along the center line 16 (and a radial axis), rotation of the blade 13 about the center line 16 does not alter the balance of the assembly. In addition, with the self-centering feature, this symmetry is maintained when a substantial clearance between the parts is used.

Figure 2:
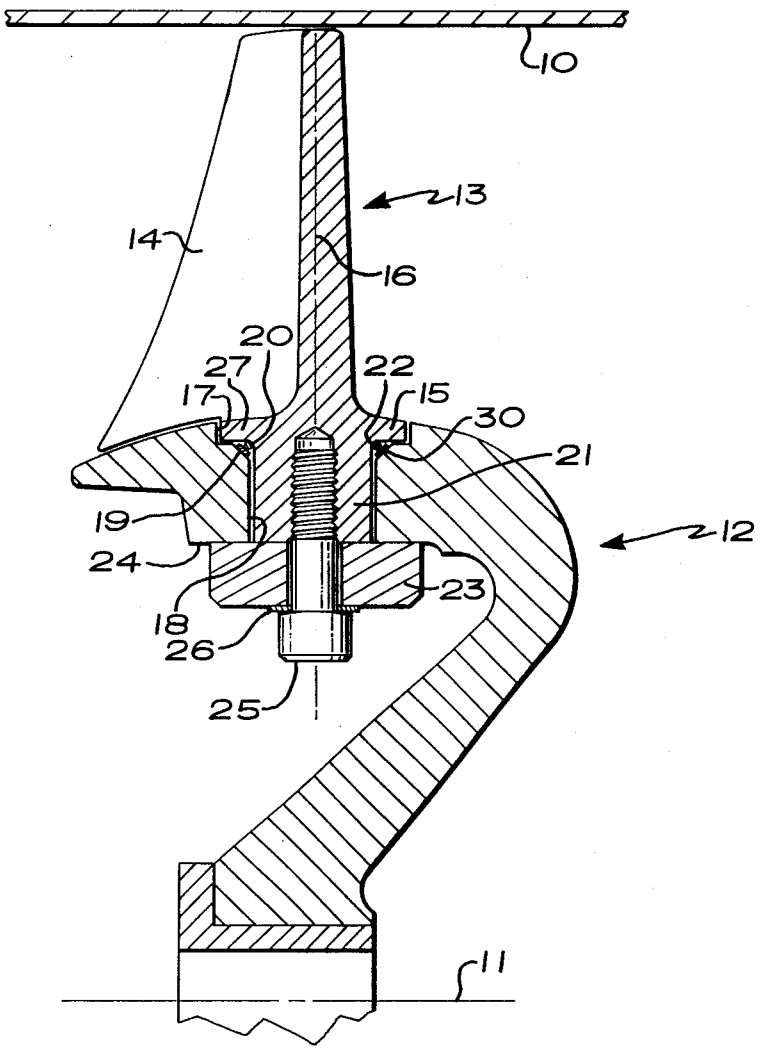
FIG. 2 is a cross-section similar to that of FIG. 1 illustrating a modification to the embodiment of FIG. 1.

Obviously, many modifications and variations of the present invention are possible in light of the above teachings. One such modification is illustrated in FIG. 2 wherein like reference numerals designate elements corresponding to those of FIG. 1. In FIG. 2, the essential difference lies in the provision of a race or sliding bearing surface 30 positioned on the conical section surface 19 and between that surface 19 and the resilient member 22. The materials of the race 30 and resilient member 22 may be selected to facilitate a sliding movement therebetween thereby preventing degradation of the resilient member 22 and a change in the preload characteristics provided by the member 22 through wear. In this manner, the "need" to tamper with a factory set preload in the blade retaining assembly (a preload of the fastener 25) is eliminated. Also, the friction force provided remains sufficient to prevent inadvertant adjustment as by hand or through aerodynamic or centrifugal component forces during operation. Additionally, the spacer 21 is shown as a unitary member with the base 15. While it is desirable that the spacer 21 be unitary, it need not be so long as the function described herein is retained. A separate spacer element may therefore be provided consistent with the teachings herein. It should also be noted that the use of a resilient member serves to reduce the amplitude of the blade natural frequency. This action is enhanced through the selection of an elastomeric material for the resilient member 22 that is inherently self-damping. The result is decrease in the vibration-induced stress in the blade thereby decreasing the potential for fatigue failure of the blade. An optimal match of the resilient element characteristics and the mass and natural frequency of the blade assembly is within the skill of one ordinarily skilled in the art. Also, the hub aperture need not be cylindrical so long as it is symmetrical with respect to a radial axis—a surface of revolution of a straight line about a radial axis, for example. Further, the junction of the shoulder 17 and spacer portion 21 of base 15 need not be formed as a radius as shown at 20. Alternatively, a conical bearing surface may be formed at that junction in opposing relation to the bearing surface 19. Finally, a single fastener 25 is illustrated securing the several components to each other. While this is preferred in many applications, multiple fasteners, or non-threaded fasteners, may be employed consistent with the requirement that symmetry be established and maintained. It is therefore to be understood that, within the scope of the appended claims, the invention may be practiced otherwise than as specifically described.

What is claimed is:

1. In an axial fan of the type wherein individual blade assemblies are clamped within apertures in a fan hub by fasteners extending between a retaining member and a blade base, each blade base including a shoulder overlying a bearing surface on the hub with resilient means positioned between the blade base shoulder and hub bearing surface, and having spacer means for maintaining the blade base shoulder and retaining member a preselected distance apart to allow prestressing of the fasteners while limiting the compressive forces applied to the resilient means, the improvement wherein the blade base shoulders and hub bearing surfaces are configured to cooperate with the resilient means to impart a centering force on a blade base relative to a hub aperture when a resilient means is compressed between a blade shoulder and hub bearing surface.

2. The axial fan of claim 1 wherein the hub apertures are generally cylindrical, said bearing surfaces being formed as conical sections coaxial with said cylindrical apertures.

3. The axial fan of claim 2 wherein said spacer means are formed as unitary extensions of the bases.

4. The axial fan of claim 1 wherein said apertures are defined by a surface of revolution of a straight line about an axis, said bearing surfaces being formed as conical sections coaxial with said apertures.

5. The axial fan of claim 4 wherein said spacer means are formed as unitary extensions of the blade base, said unitary spacer means being symmetrical with respect to a hub aperture axis when centered within a hub aperture.

6. The axial fan of claim 5 wherein said unitary spacer means comprise a threaded bore extending along their axis of symmetry, said fasteners comprising threaded members engagable with said threaded bores.

7. The axial fan of claim 6 further comprising race means engaging said resilient means for facilitating manual rotation of said base within an aperture.

8. The axial fan of claim 7 wherein said resilient means are self-damping.

9. In an axial fan of the type having a plurality of fan blades supported for rotation with a hub about a rotational axis, each blade being secured through a different aperture in the hub and extending generally along a radial axis extending from the rotation axis through a hub aperture, said hub apertures being generally symmetrical with respect to their radial axis and extending between inner and outer hub bearing surfaces, and the blades being formed of a base and an airfoil extending outwardly from the base with the base including a shoulder generally overlying the outer hub bearing surface, and having a retaining plate overlying the inner hub bearing surface, spacer means between the base shoulder and retaining plate, fastener means securing the base to the retaining plate and resilient means between the base shoulder and outer hub bearing surface, the improvement wherein at least a portion of the spacer means is unitary with said base and joins the base shoulder at a junction, the outer hub bearing surface being formed as a conical section opposing said junction.

10. The axial fan of claim 9 wherein each hub aperture, blade base, blade base shoulder, unitary spacer means portion, retaining plate and fastener are generally symmetrical and are secured coaxially relative to each other and a radial axis.

11. The axial fan of claim 10 wherein each fan blade has its center of gravity along a radial axis when supported by said hub.

12. The axial fan of claim 11 further comprising race means engaging said resilient means for facilitating manual rotation of said base within an aperture.

13. The axial fan of claim 12 wherein said resilient means are self-damping.

14. The axial fan of claim 9 wherein each fan blade has its center of gravity along a radial axis when supported by said hub.

* * * * *